United States Patent [19]

Theurer

[11] Patent Number: 5,053,591

[45] Date of Patent: Oct. 1, 1991

[54] ILLUMINATED SEALED ROCKER SWITCH

[75] Inventor: Walter C. Theurer, Bradenton, Fla.

[73] Assignee: Eaton Corporation, Cleveland, Ohio

[21] Appl. No.: 482,119

[22] Filed: Feb. 20, 1990

[51] Int. Cl.[5] ..... H01H 9/00

[52] U.S. Cl. ..... 200/315; 200/302.3; 200/339

[58] Field of Search ..... 200/302.1, 302.2, 302.3, 200/310, 313, 315, 339, 396; 220/308, 378

[56] References Cited

U.S. PATENT DOCUMENTS

| | | | |
|---|---|---|---|
| 3,024,510 | 6/1980 | Botz | 200/302.3 |
| 3,035,134 | 5/1962 | Hults | 200/67 |
| 3,483,345 | 12/1969 | Hults | 200/168 |
| 3,598,950 | 8/1971 | Ohashi | 200/167 A |
| 3,735,077 | 5/1973 | Ohashi | 200/167 A |
| 3,937,913 | 2/1976 | Soulas et al. | 200/302.2 |
| 4,013,857 | 3/1977 | Tanaka | 200/315 |
| 4,191,873 | 3/1980 | Woodard | 200/302 |
| 4,218,602 | 8/1980 | Creech | 200/302 |
| 4,242,551 | 12/1980 | Sorenson | 200/302 |
| 4,268,734 | 5/1981 | Sorenson | 200/302.3 |
| 4,290,536 | 9/1981 | Morel | 220/308 |
| 4,340,791 | 7/1982 | Sorenson | 200/302 |
| 4,476,360 | 10/1984 | Theurer | 200/302.1 |
| 4,673,780 | 6/1987 | Kenway | 200/302.2 |
| 4,843,195 | 6/1989 | Sato et al. | 200/302.3 |
| 4,937,407 | 6/1990 | Osika | 200/302.3 |
| 4,978,823 | 12/1990 | Sato et al. | 200/339 |

FOREIGN PATENT DOCUMENTS

| | | | |
|---|---|---|---|
| 2094553 | 9/1982 | United Kingdom | 200/302.3 |

*Primary Examiner*—Henry J. Recla
*Assistant Examiner*—Keith Kupferschmid
*Attorney, Agent, or Firm*—L. H. Uthoff, Jr.

[57] ABSTRACT

A silicone seal is molded-in-place to a frame and toggle lever pivotally mounted in the frame, the seal integrally providing a closed loop bead gasket on the lower surface of the frame surrounding the periphery of a switch cavity at the upper surface of a base. Lamp sockets are formed through the base and frame outside the closed loop gasket surrounding the switch cavity, the sockets being surrounded by additional closed loop gaskets integral with the seal, and further comprising lamp receiving resilient boots integral with the seal disposed in a front opening pocket of the frame for convenient insertion/removal of lamps from the front of the switch. A rocker button snaps onto a stub end of the toggle lever within the pocket to overlie the lamps, the button being provided with one or more windows and selected indicia. A panel gasket is molded-in-place to an under surface of a peripheral flange on the frame in the same molding operation as the aforementioned seal, and may also be an integral part of the seal.

31 Claims, 3 Drawing Sheets

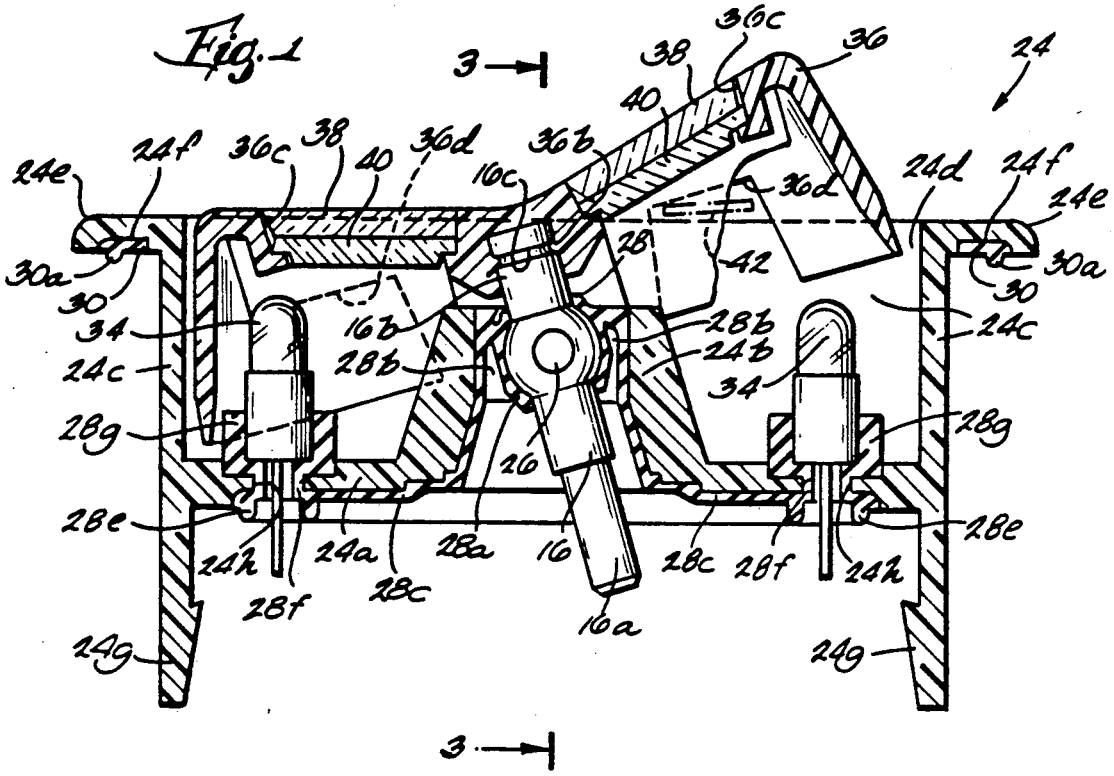
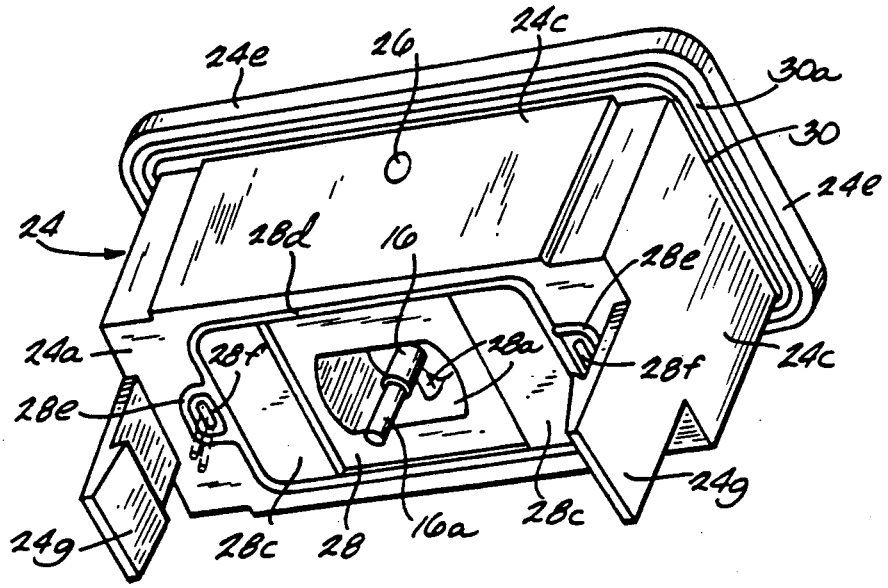
Fig. 5

36c
38
40
36b
40
38
36c
36
36d
36a
36d 34
34
24
24e
24f
16c
16b
24d
28
28b
26
28b
24b
28a
28h
28g
24h
24a
4b
16
4a
28h
28g
24c
24c
24f
24e
30a
30a
30
30
32
32
24h
28f
28e
28d
28f
28d
28e
4d
4d
14
18
24g
24g
4g
4g
4e
4e
12
6
2
4
8
10
22b
22b
8a
6a
10a
4c
22
22
8b
10b
6b

ILLUMINATED SEALED ROCKER SWITCH

BACKGROUND OF THE INVENTION

This invention relates to illuminated sealed switches of the toggle lever or rocker operator type. More particularly, this invention relates to switches of the aforementioned type wherein lamp replacement is possible and can readily be done from the front of the switch while the switch is mounted in a panel.

Illuminated rocker switches are known wherein the rocker button may be snapped off the switch actuator in order to gain access to the lamp(s) for changing the same. Sealed rocker switches are also known, such switches having a sealing member disposed across the open top of a switch base cavity and compressed between the switch base and a frame in assembly. The sealing member may be provided with a lens for transmitting light from a lamp disposed within the sealed cavity through the lens to the underside of the rocker button. Relamping of such switches requires disassembly of entire the switch. Environmentally sealed toggle switches having a completely sealed switch cavity by a molded-in-place rubber seal and sealing electric terminals are also known. The molded rubber seals the toggle lever to a mounting bushing and forms a seal between a cover and the switch base. The sealing electric terminals extend through the base and are complementally formed with the base to establish cold flow of the base material to form a seal. However, the toggle switch does not provide the illumination feature or the aesthetic features of the rocker switch.

SUMMARY OF THE INVENTION

This invention provides an illuminated sealed rocker switch which is completely sealed to prevent ingress of contaminants into the switch cavity and which is illuminated by one or more lamps replaceable from the front of the switch when the switch is mounted in a panel. In particular, the rocker switch of this invention incorporates a toggle lever actuated switch wherein the toggle lever-to-cover bushing and the cover-to-base joints are sealed by a continuous one-piece resilient sealing member molded-in-place to the cover and toggle lever and compressed between the cover and base when the cover is attached to the base. The switch cavity is further sealed by providing stationary contacts having particularly shaped terminal shanks and flanges which cooperate with the base to provide a sealing structure around each terminal. The lamp or lamps are mounted in pin type receptacles which are positioned within openings in end walls of the switch base, the resilient sealing member providing a separate seal around the receptacles between the cover and base and providing a rubber boot for surrounding the lamp within a pocket of the cover or frame. A rocker button is snapped onto a stub upper end of the toggle lever, the lever having an annular groove near its upper end and the rocker button having a constriction in a cylindrical recess which cooperate for snap fit attachment of the rocker button to the toggle lever.

The foregoing and other advantages and features of this invention will become more apparent when reading the following description and claims in conjunction with the accompanying drawings.

BRIEF DESCRIPTION OF THE DRAWINGS

FIG. 1 is a cross sectional view of a frame, toggle lever, pivot pin and rocker button assembly with integral molded-in-place resilient seal applied thereto in accordance with this invention, the rocker button and toggle lever being shown rocked to one operating position and further showing a pair of lamps inserted in sealing boots of the sealing member;

FIG. 5 is a bottom view of the frame, toggle lever, pivot pin and integral molded-in-place sealing member.

DETAILED DESCRIPTION OF THE PREFERRED EMBODIMENT

Figure 2:
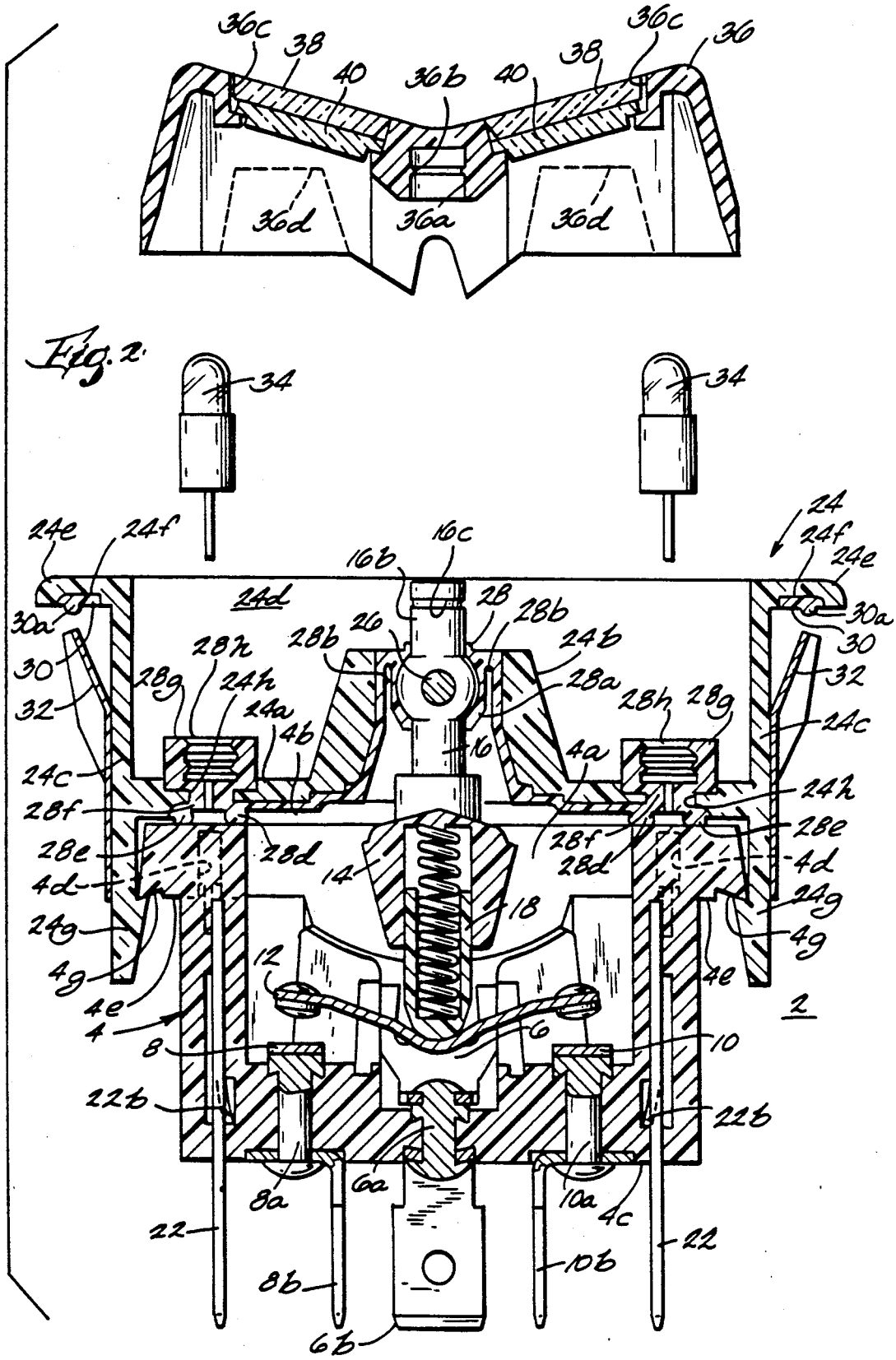
FIG. 2 is a cross sectional view of the assembly of FIG. 1 attached to a switch base and switch assembly, and showing the rocker button and lamps removed.

With reference to the drawings and particularly FIG. 2 thereof the switch 2 of this invention is illustrated in a cross sectional view. Switch 2 comprises a molded insulating base 4 having a central cavity **4*a* open to an upper surface 4*b*. A bottom wall 4*c* is provided with a plurality of holes therethrough for receiving the shanks 6*a*, 8*a*, and 10*a*, of stationary contacts 6, 8, and 10, respectively. The shanks of the respective stationary contacts protrude beyond the bottom of the base and through external wiring terminals 6*b*, 8*b*, and 10*b*, respectively, and are riveted over the respective terminals to secure the respective stationary contact and wiring terminal assembly to the base 4. These stationary contact and wiring terminal assemblies are constructed in accordance with those disclosed and claimed in my U.S. Pat. No. 4,476,360 issued Oct. 9, 1984 and assigned to the assignee of this application, which patent is incorporated herein by reference. As may be more fully understood from my above referenced patent, the stationary contact and base are formed to provide an environmental seal between the contact and base by forming a reverse angular annular surface on the under side of a head end of each contact and complementally forming the interior ends of the openings in base 4** to cause base material to be displaced upon riveting.

The switch mechanism shown in the drawings is a two pole rocking contactor mechanism of the type disclosed in A. W. Krieger, U.S. Pat. No. 2,248,362 issued July 8, 1941. A single pole version of this switch is also contemplated within the scope of this invention. The switching mechanism comprises a shallow V-shaped contactor 12 cradled for rocking movement on the stationary contact 6 in each respective pole of the switch (only one pole being shown). An insulating actuator 14 is attached to the end of a toggle lever 16, the actuator 14 extending laterally into each pole of the switch. Actuator 14 carries a pair of plungers 18 which are biased into engagement with the upper surface of the respective contactor 12 in each pole. In a well known manner, pivotal movement of the actuator 14 by the toggle lever 16 left or right as viewed in FIG. 2 causes the respective plunger 18 to traverse the upper surface of contactor 12, thereby rocking it into and out of bridging engagement between center stationary contact 6 and either of the outboard stationary contacts 8 or 10.

Figure 4:
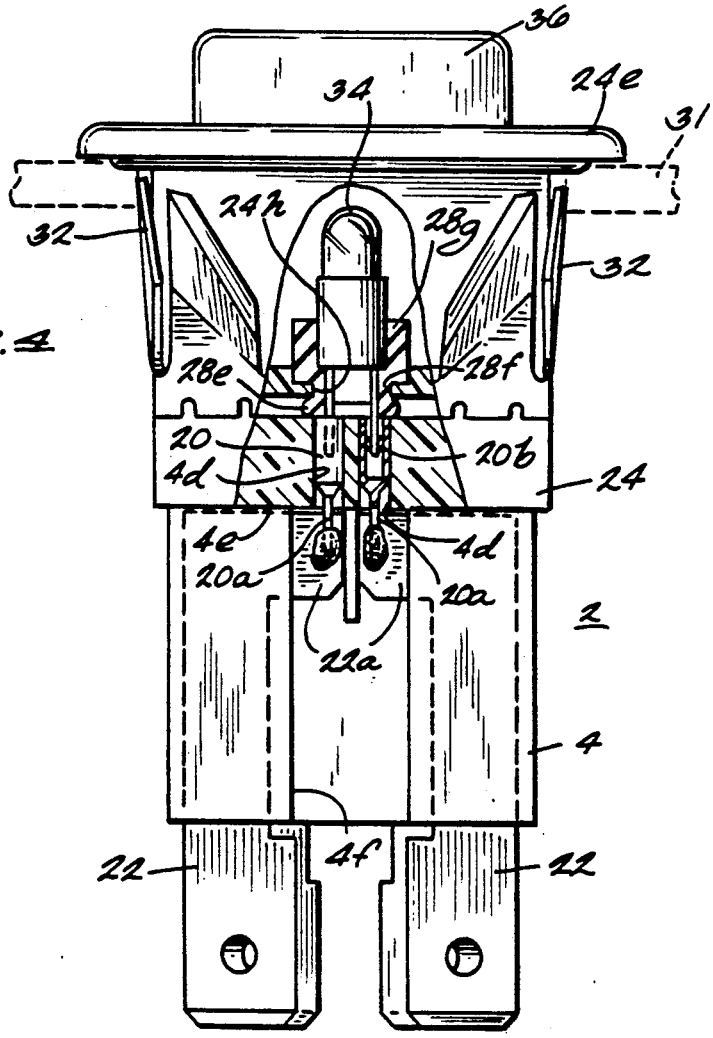
FIG. 4 is an end view of the switch assembly of FIG. 2 with a portion broken away to show push-in pin receptacles for the lamp.

Base 4 of the switch of this invention is provided with pairs of holes 4*d* in the respective left and right-hand end walls, the holes 4*d* extending between the upper surface 4*b* and an overhanging surface 4*e* on each end wall as best seen in FIG. 4. Each hole 4*d* is provided with a push-in pin receptacle 20 which is a machined cylindrical member having a reduced diameter pin 20*a* at one end and a blind cylindrical bore open to the other end. Within the bore of the machined member is a cylindrically formed spring contact having four equally spaced angular contact fingers. Pin receptacles 20 are of a common, commercially available type such as part number 0307 available from Mill-Max Mfg. Corp., Oyster Bay, New York. In the embodiment shown in the drawings, four wiring terminals 22 are respectively mounted at the four corners of switch base 4 in slots that are open to opposite sides of base 4. In particular applications, fewer than four wiring terminals may be used. Terminals 22 each have a laterally extending tab 22*a* at the upper end thereof which projects through a respective opening into a recessed area 4*f* of the respective end walls of base 4 to extend behind the respective pins 20*a* of pin receptacles 20. Pins 20*a* are preferably soldered to tabs 22*a* to form a good mechanical and electrical bond therebetween. The lower ends of terminals 22 are lanced at 22*b* (FIG. 2) to provide an interference fit within a widened area of the respective slots in base 4 to retain the terminals in place.

FIG. 1 shows a primary subassembly component of switch 2. An insulating frame 24 molded of thermoplastic material comprises a transverse wall 24*a* having a bushing 24*b* projecting upwardly therefrom, and a four-sided continuous wall 24*c* extending upwardly from the outer edges of transverse wall 24*a* to form an upwardly opening pocket 24*d*. A peripheral flange 24*e* projects outwardly from continuous wall 24*c* at the upper end thereof. The under surface of flange 24*e* is relieved at 24*f* adjacent the wall 24*c* and extending outwardly over approximately two-thirds the width of flange 24*e*. The end walls of frame 24 comprise depending hooks 24*g* which cooperate with undercut surfaces 4*g* (FIG. 2) on base 4 to attach the frame to the base with a snap fit. A pair of oblong openings 24*h* are provided at opposite ends of transverse wall 24*a*, a respective opening 24*h* being aligned with and overlying a pair of pin receptacles 20 in the upper surface 4*b* of base 4. Toggle lever 16 extends through a hole in the bushing 24*b* and is pivotally mounted within the bushing by a pivot pin 26 which is inserted through aligned openings in the side portions of continuous wall 24*c*, bushing 24*b* and toggle lever 16. The lower end 16*a* of toggle lever 16 is disposed within the cavity 4*a* and is received in a complementary opening (not shown) in actuator 14 when frame 24 is attached to base 4. The upper end of toggle lever 16 is foreshortened to provide a stub upper end 16*b* having an annular groove 16*c* spaced axially downward from the upper distal end of the toggle lever.

The frame 24 is provided with a one-piece or continuous resilient seal member 28 which is molded in place as taught in U.S. Pat. No. 3,483,345 issued Dec. 9, 1969, to Harold W. Hults and assigned, by mesne assignments, to the assignee of this application. The sealing member 28 is composed of resilient insulating material such as silicone rubber and is molded in place after pivot pin 26 has been inserted to assemble the toggle lever 16 in the bushing 24*b*. In the molding process, a bonding agent is first applied to cause the silicone rubber to adhere to the respective parts.

Figure 3:
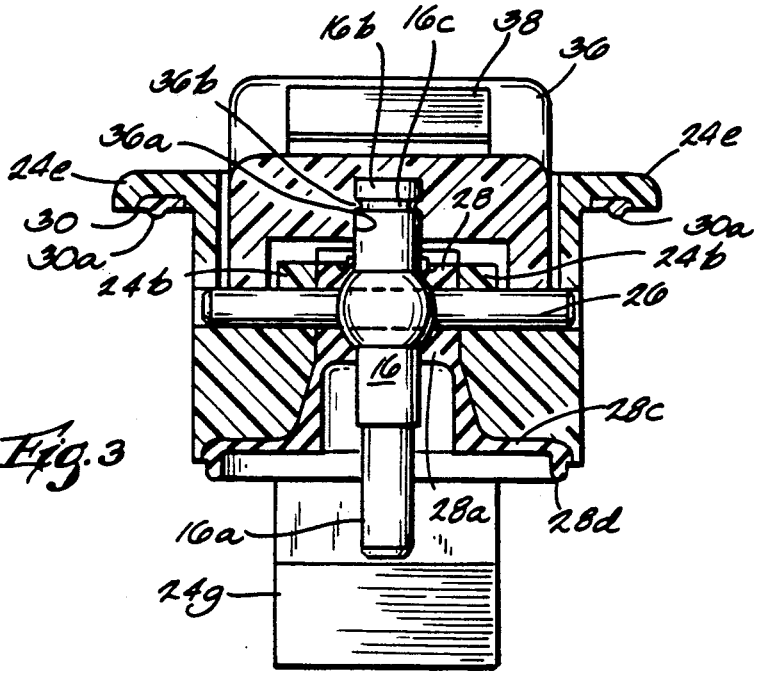
FIG. 3 is a transverse cross sectional view taken along the line 3—3 in FIG. 1.

Sealing member 28 is provided with a first portion 8*a* that surrounds the spherical pivot portion of toggle lever 16 and the pivot pin 26 to fill the space around the end portions of the pivot pin 26 between the toggle lever 16 and the bushing 24*b* as shown in FIG. 3. Deep grooves 28*b* are molded in portion 28*a* between the toggle lever and the bushing laterally of and on two opposite sides of the pivot pin 26 for ease of pivoting the lever. The portion 28*a* lines the entire inner surface of the opening in bushing 24*b* and extends to the bottom surface of transverse wall 24*a* whereat a second portion 28*c* integral with the first portion 28*a* adheres to and extends along a substantially flat bottom surface of transverse wall 24*a*. A bead 28*d* depends integrally from portion 28*c* near the peripheral edge thereof to form an endless loop disposed in correspondence with the peripheral edge of cavity 4*a* on upper surface 4*b* of base 4. A pair of auxiliary endless loops are formed by respective continuances 28*e* of bead 28*d*, the auxiliary loops surrounding the openings 24*h* in transverse wall 24*a* and forming an auxiliary loop in aligned correspondence with the pin receptacles 20. Sealing member 28 also comprises integral portions 28*f* that line oblong holes 24*h* in the transverse wall 24*a* and integrally interconnect portion 28*c* with upstanding, substantially cylindrical, resilient sealing boots 28*g* extending upward from transverse wall 24*a* within pocket 24*d*. The cylindrical opening in boots 28*g* which form lamp receiving cavities 28*h* which are provided with one or more constrictive rings molded in the internal surface (FIG. 2) to enhance the sealing engagement with the body of a lamp inserted therein. Frame 24 is also provided with a second sealing member 30 which is molded in place in relieved area 24*f* on the under side of peripheral flange 24*e*. In the preferred construction, second sealing member 30 is molded in place separately, but simultaneously (in the same molding operation) with the molding of the first sealing member 28. It is contemplated that the first and second sealing members 28 and 30 could be one continuous sealing member joined by risers or sprues of the molding process which could extend upward along the exterior side walls of wall 24*c* of the frame. Second sealing member 30 has a depending bead 30*a* formed along the periphery thereof.

The frame 24 and its assembled elements are attached to base 4 by pressing it down upon the upper surface 4*b* of the base, causing hooks 24*g* to be deflected outwardly by beveled surfaces adjacent undercut surfaces 4*g* of base 4 until the hooks 24*g* snap over and engage undercut surfaces 4*g* of base 4. When so attached, beads 28*d* and 28*e* of first seal member 28 are compressed against upper surface 4*b* of base 4, providing a seal around cavity 4*a* and around the openings of pin receptacles 20. When switch 2 is inserted into a suitable opening in a panel 31 (FIG. 4), bead 30*a* is compressed against the surface of the panel by engagement of retaining fingers 32 (FIG. 2) which are compressively attached to the frame 24 in a well known manner. Sealing member 30 and bead 30*a* form a gasket around the panel opening, providing a sealed connection between the switch 2 and the panel. First sealing member 28 and the respective endless loop beads 28*d* and 28*e* form effective seals between the frame 24 and base 4 of the switch. Sealing is completed by insertion of lamps 34 into boots 28*g* such that the two wire leads of each lamp are pushed into pin receptacles 20 for electrical connection therewith. This insertion of the lamps is accomplished through the upwardly opening pocket 24*d* which is at the front side of the panel to which the switch 2 is mounted.

A rocker button operator 36 is snap fit attached to the stub upper end 16*b* of toggle lever 16 by placing a cylindrical recess 36*a* in the button over the shaft and pressing button 36 downward until an annular constriction 36*b* in recess 36*a* engages within the annular groove 16*c* of toggle lever 16. The upper surface of button 36 may be provided with a pair of snap in lenses 38 which in turn trap indicia plates 40 within seats in windows 36*c* in the button 36. The external side surfaces of button 36 are provided with undercut areas 36*d* to facilitate removal of button 36 from toggle lever 16 by prying between an upper edge of the relieved area and an upper edge of wall 24*c* with a screwdriver such as represented by the rectangle 42 at the right-hand side of FIG. 1. When rocker button 36 is so removed, lamps 34 are accessible from the front of panel 31 through pocket 24*d*. Lamps 34 may be pulled directly out of the boots 28*g* and pin receptacles 20 and new lamps inserted.

The foregoing has described an illuminated rocker switch which is completely sealed, and yet has lamps which are readily replaceable from the front of a panel in which the switch is mounted, while the switch remains mounted in place. It is to be understood that while the invention has been described in a preferred best mode embodiment, it is not intended to be confined to the particular embodiment disclosed inasmuch as it is susceptible of various modifications without departing from the scope of the claims.

I claim:

1. An illuminated environmentally sealed rocker switch comprising:

a hollow insulating base having a central cavity open to an upper surface of said base and a pair of push-in receptacle terminals mounted in an end wall of said base, said terminals being open to said upper surface;

switch contacts mounted in said cavity connected through a wall of said base to respective terminals attached externally to said base;

switching means in said cavity actuable to selectively connect respective ones of said switch contacts;

a frame attached to said base, said frame comprising a cover overlying said upper surface closing said cavity, said cover having an opening therethrough aligned with said receptacle terminals, a cylindrical bushing extending upwardly from said cover, a hole extending through said bushing communicating with said cavity;

a toggle lever extending through said hole in said bushing having an upper end disposed externally of said cover and a lower end disposed within said cavity;

a pin extending through said bushing and said toggle lever mounting said toggle lever for limited rocking movement in a plane transverse to said pin;

actuator means in said cavity connecting said lower end of said toggle lever to said switching means;

a rocker button operator attached to said toggle lever upper end;

rocker button attachment means facilitating removal and replacement of said rocker button on said toggle lever;

sealing means comprising a continuous pliable member molded in situ to said frame, toggle lever and pivot pin, intimately surrounding said toggle lever and said pivot pin and lining an interior surface of said hole in said bushing, bridging a space therebetween and closing said hole, said pliable member extending upwardly through said opening in said cover and forming a pliable lamp receiving cavity, said lamp receiving cavity being positioned to direct a lamp for emitting light at said rocker button, said pliable member establishing an environmental seal of said cover, said base and said toggle lever; and a lamp having a cylindrical base disposed in said cavity, insertion of said lamp base into said lamp receiving cavity firmly contacting and compressing said inner surface of said lamp receiving cavity continuously along the periphery of said lamp base, said lamp having pin type terminal wires passing through openings in said lamp receiving cavity aligned with said receptacle terminals and engaging said push-in receptacle terminals whereby said lamp is replaced from a rocker side of said switch by removing said rocker button from said toggle lever, exposing said lamp, removing said lamp by pulling said lamp from said lamp receiving cavity, replacement by simply pushing said lamp into said lamp receiving cavity engaging said pin terminal wires with said push-in pin receptacle terminals, said insertion of said lamp base into said lamp receiving cavity completing an environmental seal of said switch making said switch impervious to external contaminants.

2. The illuminated environmentally sealed rocker switch defined in claim 1 wherein said lamp receiving cavity comprises a hollow substantially cylindrical upstanding boot open at a distal end, an interior surface thereof having at least one reduced diameter annular ring molded integrally therein.

3. The illuminated environmentally sealed rocker switch defined in claim 1 wherein said respective opening in said cover and said respective auxiliary endless loop surrounding said respective opening are disposed outside said loop surrounding said cavity.

4. The illuminated environmentally sealed rocker switch defined in claim 3 wherein a portion of said bead forming said respective auxiliary endless loop is common with a portion of said bead forming said endless loop.

5. The illuminated environmentally sealed rocker switch defined in claim 1 wherein said base and said frame comprise cooperating means for snap-fit attachment of said frame to said base.

6. The illuminated environmentally sealed rocker switch defined in claim 5 wherein said cooperating means comprises a pair of overhanging surfaces on said base and a pair of depending hooks on said frame engaging said overhanging surfaces.

7. The illuminated environmentally sealed rocker switch defined in claim 1 wherein said rocker button is snap-fit attached to said toggle lever.

8. The illuminated environmentally sealed rocker switch defined in claim 7 wherein said upper end of said toggle lever comprises an annular groove axially spaced from said upper end and said rocker button comprises a cylindrical recess receiving said upper end therein, said recess having an annular constriction integrally formed on its cylindrical surface, said constriction being received in said groove upon attachment of said rocker button to said toggle lever.

9. The illuminated environmentally sealed rocker switch defined in claim 1 wherein said continuous wall of said frame comprises an outwardly projecting peripheral flange having a resilient gasket molded in situ to an under surface thereof, said gasket comprising a depending peripheral bead.

10. The illuminated environmentally sealed rocker switch defined in claim 9 wherein said under surface of said flange comprises a relieved area spaced inwardly from an outer edge of said flange, said resilient gasket filling said relieved area substantially flush with said under surface of said flange at said outer edge thereof, and said peripheral bead depending below said under surface of said flange.

11. The illuminated environmentally sealed rocker switch defined in claim 10 wherein said continuous resilient member and said resilient gasket comprise the same material and are each molded in situ to said frame in a single molding operation.

12. The illuminated environmentally sealed rocker switch defined in claim 1, wherein said lamp receiving cavity has a constant inner diameter thereby continuously contacting the base of said lamp and establishing an environmental seal.

13. The illuminated environmentally sealed rocker switch defined in claim 1, wherein said lamp receiving cavity has an inner diameter established by a plurality of annular rings that extend from the inner cylindrical surface of said lamp receiving cavity and make continuous circumferential contact with the base of said lamp thereby establishing an environmental seal.

14. The illuminated environmentally sealed rocker switch defined in claim 1, wherein said pliable member has a depending bead forming an endless loop disposed in aligned correspondence over said upper surface of said base surrounding said cavity and forming a respective auxiliary endless loop surrounding a respective said opening in said cover, said bead being compressively deformed by said upper surface of said base.

15. An illuminated environmentally sealed rocker switch comprising:

a hollow insulating base having a central cavity open to an upper surface of said base and a pair of push-in pin receptacle terminals mounted in an end wall of said base, said terminals being open to said upper surface;

electric switching means in said cavity;

a frame attached to said base, said frame comprising a cover overlying said upper surface closing said cavity, an opening in said cover aligned with said pair of receptacles, a cylindrical bushing extending upwardly from said cover, a hole extending through said bushing communicating with said cavity, and a continuous peripheral wall extending upwardly from said cover, said wall being spaced from an continuously surrounding said bushing, said continuous peripheral wall defining an upwardly open pocket of said frame;

a toggle lever extending through said hole in said bushing having an upper end of said lever disposed within said pocket and a lower end of said lever disposed within said cavity and connected to said switching means;

a pin extending through said bushing and said toggle lever mounting said toggle lever for limited rocking movement in a plane transverse to said pin;

actuator means in said cavity connecting said lower end of said toggle lever to said switching means;

sealing means comprising a continuous pliable member molded in situ to said frame, said member intimately surrounding said toggle lever and said pivot pin and lining an interior surface of said hole in said bushing, bridging a space therebetween and closing said hole, said member further extending along a bottom surface of said cover;

a lamp disposed in said pocket having a pair of wire pin terminal leads extending through said opening in said cover and pushed into said receptacles in said base, effecting electrical connection therewith, from an open upper end of said pocket with said frame attached to said base, said lamp base contacting and compressively deforming said pliable member establishing an environmental seal;

a rocker button removably attached to said upper end of said toggle lever within said pocket, said button overlying said lamp; and rocker button attachment means whereby said rocker button can be removed from said toggle lever and then replaced without damage.

16. The illuminated environmentally sealed rocker switch claimed in claim 15 wherein said pliable member extends upwardly through said opening, lining an interior surface of said opening, and forming a lamp receiving cavity, said lamp receiving cavity being positioned to direct a lamp for emitting light at said rocker button.

17. The illuminated environmentally sealed rocker switch defined in claim 16, wherein said lamp receiving cavity has a constant inner diameter thereby continuously contacting the base of said lamp and establishing an environmental seal.

18. The illuminated environmentally sealed rocker switch defined in claim 16, wherein said lamp receiving cavity has an inner diameter established by a plurality of annular rings that extend from the inner cylindrical surface of said lamp receiving cavity and make continuous circumferential contact with the base of said lamp thereby establishing an environmental seal.

19. The illuminated environmentally sealed rocker switch claimed in claim 16 wherein said cylindrical holder comprises at least one annular restriction on its interior surface.

20. The illuminated environmentally sealed rocker switch claimed in claim 15 wherein said rocker button is snap-fit attached to said toggle lever.

21. The illuminated environmentally sealed rocker switch claimed in claim 20 wherein said upper end of said toggle lever has an annular groove spaced from said upper end and said rocker button comprises a cylindrical recess having an annular restriction on a surface thereof, said constriction being received in said groove upon snap-fit attachment of said button to said toggle lever.

22. The illuminated environmentally sealed rocker switch claimed in claim 15 wherein said frame comprises a peripheral flange projecting outwardly from said continuous wall and a resilient gasket is molded in situ to an under surface of said flange, said gasket having a depending peripheral continuous bead.

23. The illuminated environmentally sealed rocker switch claimed in claim 22 wherein said under surfaoe of said flange comprises a relieved area inwardly of an outer edge of said flange and said resilient gasket is molded into said relieved area, substantially flush with said under surface of said flange at said outer edge thereof, and said depending bead projects below said under surface of said flange.

24. The illuminated environmentally sealed rocker switch claimed in claim 23 wherein said continuous resilient member and said resilient gasket are simultaneously molded in situ to said frame in a single molding operation.

25. The illuminated environmentally sealed rocker switch defined in claim 15, wherein said pliable member has a depending bead forming an endless loop disposed in aligned correspondence over said upper surface of said base surrounding said cavity and forming a respective auxiliary endless loop surrounding a respective said opening in said cover, said bead being compressively deformed by said upper surface of said base.

26. An illuminated sealed rocker switch comprising:

a hollow insulating base having a central cavity open to an upper surface;

switch contacts mounted in said cavity connected through a wall of said base to respective terminals attached externally to said base;

switching means in said cavity actuable to selectively connect respective ones of said switch contacts;

a frame attached to said base, said frame comprising a cover overlying said upper surface closing said cavity, a bushing extending upwardly from said cover, and a continuous wall extending upwardly from said cover spaced from and surrounding said bushing defining a pocket open to an upper surface of said frame;

a toggle lever extending through said bushing having an upper end disposed within said pocket and a lower end disposed within said cavity;

a pin extending rough said bushing and said toggle lever mounting said toggle lever for limited rocking movement in a plane transverse to said pin;

actuator means in said cavity connecting said lower end of said toggle lever to said switching means;

a rocker button operator removably attached to said toggle lever upper end within said pocket;

at least one lamp disposed in said pocket under said rocker button emitting light visible through said rocker button, said lamp having terminal wires passing through a respective opening in said cover and removably received in push-in terminals disposed in said base open to said upper surface of said base, said lamp being replaceable with said frame attached to said base by removing said rocker button from said toggle lever and said pocket, thereby exposing said lamp, pulling said lamp from said pocket, thereby also removing said terminal wires from said push-in terminals, and inserting terminal wires of a replacement lamp through said respective opening and into said push-in terminals; and sealing means comprising a continuous resilient member molded in situ to said frame, toggle lever and pivot pin, intimately surrounding said toggle lever and said pivot pin and lining an interior surface of said bushing, bridging a space therebetween, said resilient member further extending along a bottom surface of said cover and having a depending bead forming an endless loop disposed in aligned correspondence over said upper surface of said base surrounding said cavity and forming a respective auxiliary endless loop surrounding a respective said opening in said cover, said bead being compressively deformed by said upper surface of said base, wherein said continuous resilient member lines an interior surface of a respective said opening, extends to an upper surface of said cover through said opening and forms an open receptacle for sealingly receiving said lamp, said open receptacle comprises a hollow substantially cylindrical upstanding boot open at a distal end, an interior surface thereof having at least one reduced diameter annular ring molded integrally therein.

27. An illuminated sealed rocker switch comprising:

a hollow insulating base having a central cavity open to an upper surface;

switch contacts mounted in said cavity connected through a wall of said base to respective terminals attached externally to said base;

switching means in said cavity actuable to selectively connect respective ones of said switch contacts;

a frame attached to said base, said frame comprising a cover overlying said upper surface closing said cavity, a bushing extending upwardly from said cover, and a continuous wall extending upwardly from said cover spaced from and surrounding said bushing defining a pocket open to an upper surface of said frame;

a toggle lever extending through said bushing having an upper end disposed within said pocket and a lower end disposed within said cavity;

a pin extending through said bushing and said toggle lever mounting said toggle lever for limited rocking movement in a plane transverse to said pin;

actuator means in said cavity connecting said lower end of said toggle lever to said switching means;

a rocker button operator removably attached to said toggle lever upper end within said pocket;

at least one lamp disposed in said pocket under said rocker button emitting light visible through said rocker button, said lamp having terminal wires passing through a respective opening in said cover and removably received in push-in terminals disposed in said base open to said upper surface of said base, said lamp being replaceable with said frame attached to said base by removing said rocker button from said toggle lever and said pocket, thereby exposing said lamp, pulling said lamp from said pocket, thereby also removing said terminal wires from said push-in terminals, and inserting terminal wires of a replacement lamp through said respective opening and into said push-in terminals; and sealing means comprising a continuous resilient member molded in situ to said frame, toggle lever and pivot pin, intimately surrounding said toggle lever and said pivot pin and lining an interior surface of said bushing, bridging a space therebetween, said resilient member further extending along a bottom surface of said cover and having a depending bead forming an endless loop disposed in aligned correspondence over said upper surface of said base surrounding said cavity and forming a respective auxiliary endless loop surrounding a respective said opening in said cover, said bead being compressively deformed by said upper surface of said base, wherein said respective opening in said cover and said respective auxiliary endless loop surrounding said respective opening are disposed outside said loop surrounding said cavity.

28. The illuminated sealed rocker switch defined in claim 27 wherein a portion of said bead forming said respective auxiliary endless loop is common with a portion of said bead forming said endless loop.

29. An illuminated sealed rocker switch comprising:

a hollow insulating base having a central cavity open to an upper surface;

switch contacts mounted in said cavity connected through a wall of said base to respective terminals attached externally to said base;

switching means in said cavity actuable to selectively connect respective ones of said switch contacts;

a frame attached to said base, said frame comprising a cover overlying said upper surface closing said cavity, a bushing extending upwardly from said cover, and a continuous wall extending upwardly from said cover, and spaced from and surrounding said bushing defining a pocket open to an upper surface of said frame;

a toggle lever extending through said bushing having an upper end disposed within said pocket and a lower end disposed within said cavity;

a pin extending through said bushing and said toggle lever mounting said toggle lever for limited rocking movement in a plane transverse to said pin;

actuator means in said cavity connecting said lower end of said toggle lever to said switching means;

a rocker button operator removably attached to said toggle lever upper end within said pocket;

at least one lamp disposed in said pocket under said rocker button emitting light visible through said rocker button, said lamp having terminal wires passing through a respective opening in said cover and removably received in push-in terminals disposed in said base open to said upper surface of said base, said lamp being replaceable with said frame attached to said base by removing said rocker button from said toggle lever and said pocket, thereby exposing said lamp, pulling said lamp from said pocket, thereby also removing said terminal wires from said push-in terminals, and inserting terminal wires of a replacement lamp through said respective opening and into said push-in terminals; and sealing means comprising a continuous resilient member molded in situ to said frame, toggle lever and pivot pin, intimately surrounding said toggle lever and said pivot pin and lining an interior surface of said bushing, bridging a space therebetween, said resilient member further extending along a bottom surface of said cover and having a depending bead forming an endless loop disposed in aligned correspondence over said upper surface of said base surrounding said cavity and forming a respective auxiliary endless loop surrounding a respective said opening in said cover, said bead being compressively deformed by said upper surface of said base, wherein said rocker button is snap-fit attached to said toggle lever, said upper end of said toggle lever comprises an annular groove axially spaced from said upper end and said rocker button comprises a cylindrical recess receiving said upper end therein, said recess having an annular constriction integrally formed on its cylindrical surface, said constriction being received in said groove upon attachment of said rocker button to said toggle lever.

30. An illuminated rocker switch comprising:

a hollow insulating base having a central cavity open to an upper surface of said base and a pair of push-in pin receptacle terminals mounted in an end wall of said base open to said upper surface;

electric switching means in said cavity;

a frame attached to said base, said frame comprising a cover overlying said upper surface closing said cavity, an opening in said cover aligned with said pair of receptacles, a bushing extending upwardly from said cover, a continuous wall extending upwardly from said cover, said wall being spaced from and surrounding said bushing and defining an upwardly open pocket, and a peripheral flange projecting outwardly from said continuous wall;

a toggle lever extending through said bushing, an upper end of said lever disposed in said pocket and a lower end of said lever disposed in said cavity connected to said switching means.

a pin extending through said bushing and said toggle lever mounting said toggle lever for limited rocking movement in a plane transverse to said pin, selected said rocking movement actuating said switching means;

sealing means comprising a continuous resilient member molded-in-place to said frame, toggle lever and pivot pin, said member surrounding said toggle lever and pivot pin and lining an interior surface of said bushing, spanning a space therebetween, said resilient member further extending along a bottom surface of said cover and having a depending bead forming an endless loop disposed in aligned correspondence with said upper surface of said base surrounding said cavity and forming an auxiliary endless loop surrounding said opening in said cover, said bead being compressed by said upper surface upon attachment of said frame to said base, said resilient member extending upwardly through said opening, lining an interior surface of said opening, and providing a resilient cylindrical holder for said lamp within said pocket, said cylindrical holder comprising at least one annular restriction on its interior surface;

a lamp disposed in said pocket having a pair of wire terminal leads extending through said opening and pushed into said receptacles in said base from an open upper end of said pocket; and a rocker button removably attached to said upper end of said toggle lever within said pocket, said button overlying said lamp.

31. An illuminated rocker switch comprising:

a hollow insulating base having a central cavity open to an upper surface of said base and a pair of push-in pin receptacle terminals mounted in an end wall of said base open to said upper surface;

electric switching means in said cavity;

a frame attached to said base, said frame comprising a cover overlying said upper surface closing said cavity, an opening in said cover aligned with said pair of receptacles, a bushing extending upwardly from said cover, a continuous wall extending upwardly from said cover, said wall being spaced from and surrounding said bushing and defining an upwardly open pocket, and a peripheral flange projecting outwardly from said continuous wall;

a toggle lever extending through said bushing, an upper end of said lever disposed in said pocket and a lower end of said lever disposed in said cavity connected to said switching means.

a pin extending through said bushing and said toggle lever mounting said toggle lever for limited rocking movement in a plane transverse to said pin, selected said rocking movement actuating said switching means;

sealing means comprising a continuous resilient member molded-in-place to said frame, toggle lever and pivot pin, said member surrounding said toggle lever and pivot pin and lining an interior surface of said bushing, spanning a space therebetween, said resilient member further extending along a bottom surface of said cover and having a depending bead forming an endless loop disposed in aligned correspondence with said upper surface of said base surrounding said cavity and forming an auxiliary endless loop surrounding said opening in said cover, said bead being compressed by said upper surface upon attachment of said frame to said base;

a lamp disposed in said pocket having a pair of wire terminal leads extending through said opening and pushed into said receptacles in said base from an open upper end of said pocket;

a rocker button snap-fit attached to said upper end of said toggle lever within said pocket, said button overlying said lamp, said upper end of said toggle lever has an annular groove spaced from said upper end and said rocker button comprises a cylindrical recess having an annular restriction on a surface thereof, said constriction being received in said groove upon snap-fit attachment of said button to said toggle lever.

* * * * *